US006576605B1

(12) United States Patent
Daiki

(10) Patent No.: US 6,576,605 B1
(45) Date of Patent: Jun. 10, 2003

(54) PROCESS FOR MAKING A FREE FLOWING DETERGENT COMPOSITION

(75) Inventor: Mayumi Daiki, Sumiyoshimiya-machi (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/787,445

(22) PCT Filed: Oct. 28, 1998

(86) PCT No.: PCT/US98/22896

§ 371 (c)(1),
(2), (4) Date: Mar. 19, 2001

(87) PCT Pub. No.: WO00/24861

PCT Pub. Date: May 4, 2000

(51) Int. Cl.[7] ..... C11D 11/00; C11D 11/04

(52) U.S. Cl. ..... 510/444; 510/441; 510/495; 510/498; 264/117; 264/140

(58) Field of Search ..... 510/444, 276, 510/351, 352, 441, 495, 498; 264/117, 140

(56) References Cited

U.S. PATENT DOCUMENTS

| | | | | | |
|---|---|---|---|---|---|
| 5,164,108 | A | * | 11/1992 | Appel et al. | 510/444 |
| 5,490,954 | A | * | 2/1996 | Van der Hoeven et al. | 510/536 |
| 5,527,489 | A | * | 6/1996 | Tadsen et al. | 510/444 |
| 5,573,697 | A | * | 11/1996 | Riddick et al. | 510/359 |
| 5,945,395 | A | * | 8/1999 | Yamashita et al. | 510/444 |
| 6,100,232 | A | * | 8/2000 | Capeci et al. | 510/444 |

FOREIGN PATENT DOCUMENTS

| | | | |
|---|---|---|---|
| EP | 0352135 | A1 * | 1/1990 |
| EP | 0438320 | | 7/1991 |
| WO | WO 98/11193 | A1 * | 3/1998 |
| WO | WO 9820104 | | 5/1998 |
| WO | WO 9838279 | | 9/1998 |

* cited by examiner

*Primary Examiner*—Lorna M. Douyon
(74) *Attorney, Agent, or Firm*—Brian M. Bolam; Kim William Zerby; Steven W. Miller

(57) ABSTRACT

A non-tower process for preparing a granular detergent composition, the process comprising the following steps: (i) fluidizing powder materials in a high-speed mixer/granulator having both a stirring action and a cutting action, the powder materials comprising: particulate solid water-soluble alkaline inorganic material in an amount in excess of that required for neutralization, optionally in admixture with one or more other particulate solids, and recycled fines, the powder materials having a total surface area; (ii) adding the liquid detersive materials to the high-speed mixer/granulator, the liquid detersive materials comprising: a liquid acid precursor, optionally in admixture with one or more other liquid materials, whereby neutralization of the acid precursor by the water-soluble alkaline inorganic material occurs; and (iii) granulating the mixture in the high-speed mixer/granulator to form detergent particles, wherein the ratio of the total surface area of the powder materials to the amount of liquid detersive materials in step (ii) is from about 0.02 to about 140.

2 Claims, No Drawings

PROCESS FOR MAKING A FREE FLOWING DETERGENT COMPOSITION

FIELD

The present invention relates to a non-tower process for producing a particulate detergent composition. The process produces a free flowing, detergent composition whose density can be adjusted for a wide range of consumer needs, and which can be commercially sold as a conventional detergent composition.

BACKGROUND

Recently, there has been considerable interest within the detergent industry for laundry detergents which are "compact" and therefore, have low dosage volumes. To facilitate production of these so-called low dosage detergents, many attempts have been made to produce high bulk density detergents, for example with a density of 600 g/l or higher. The low dosage detergents are currently in high demand as they conserve resources and can be sold in small packages which are more convenient for consumers. However, the extent to which modern detergent products need to be "compact" in nature remains unsettled. In fact, many consumers, especially in developing countries, continue to prefer a higher dosage levels in their respective laundering operations. Consequently, there is a need in the art of producing modern detergent compositions for flexibility in the ultimate density of the final composition.

Generally, there are two-.primary types of processes by which detergent granules or powders can be prepared. The first type of process involves spray-drying an aqueous detergent slurry in a spray-drying tower to produce highly porous detergent granules. In the second type of process, the various detergent components are dry mixed after which they are agglomerated with a binder such as a nonionic or anionic surfactant. In both processes, the most important factors which govern the density of the resulting detergent granules are the density, porosity and surface area, shape of the various starting materials and their respective chemical composition. These parameters, however, can only be varied within a limited range. Thus, flexibility in the substantial bulk density can only be achieved by additional processing steps which lead to lower density of the detergent granules.

There have been many attempts in the art for providing processes which increase the density of detergent granules or powders. Particular attention has been given to densification of spray-dried granules by post tower treatment. For example, one attempt involves a batch process in which spray-dried or granulated detergent powders containing sodium tripolyphosphate and sodium sulfate are densified and spheronized in a Marumerizer®. This apparatus comprises a substantially horizontal, roughened, rotatable table positioned within and at the base of a substantially vertical, smooth walled cylinder. This process, however, is essentially a batch process and is therefore less suitable for the large scale production of detergent powders. More recently, other attempts have been Is made to provide continuous processes for increasing the density of "post-tower" or spray dried detergent granules. Typically, such processes require a first apparatus which pulverizes or grinds the granules and a second apparatus which increases the density of the pulverized granules by agglomeration. While these processes achieve the desired increase in density by treating or densifying "post tower" or spray dried granules, they do not provide a process which has the flexibility of providing lower density granules.

Moreover, all of the aforementioned processes are directed primarily for densifying or otherwise processing spray dried granules. Currently, the relative amounts and types of materials subjected to spray drying processes in the production of detergent granules has been limited. For example, it has been difficult to attain high levels of surfactant in the resulting detergent composition, a feature which facilitates production of detergents in a more efficient manner. Thus, it would be desirable to have a process by which detergent compositions can be produced without having the limitations imposed by conventional spray drying techniques.

Recently, there has been considerable interest in the use of high-speed mixer/granulators for the preparation of high-bulk density detergent granules. In such process, fines that are generated during the process are usually recycled. In most cases, the fines are recycled and added with the initial powder materials.

Based on the foregoing, there is a need to ensure a balance of the amount of generated fines with the amount of recycled fines so that the over accumulation of generated fines do not shut down the process for making detergent granules.

None of the existing art provides all of the advantages and benefits of the present invention.

SUMMARY

The present invention relates to a non-tower process for preparing a granular detergent composition, the process comprising the following steps: (i) fluidising powder materials in a high-speed mixer/granulator having both a stirring action and a cutting action, the powder materials comprising: particulate solid water-soluble alkaline inorganic material in an amount in excess of that required for neutralization, optionally in admixture with one or more other particulate solids, and recycled fines, the powder materials having a total surface area; (ii) adding the liquid detersive materials to the high-speed mixer/granulator, the liquid detersive materials comprising: a liquid acid precursor, optionally in admixture with one or more other liquid materials, whereby neutralization of the acid precursor by the water-soluble alkaline inorganic material occurs; and (iii) granulating the mixture in the high-speed mixer/granulator to form detergent particles, wherein the ratio of the total surface area of the powder materials to the amount of liquid detersive materials in step (ii) is from about 0.02 to about 140.

These and other features, aspects, and advantages of the present invention will become evident to those skilled in the art from a reading of the present disclosure.

DETAILED DESCRIPTION

While this specification concludes with claims distinctly pointing out and particularly claiming that which is regarded as the invention, it is believed that the invention can be better understood through a careful reading of the following detailed description of the invention. In this specification, all percentages, ratios, and proportions are by weight, all temperatures are expressed in degrees Celsius, molecular weights are in weight average, and the decimal is represented by the point (.), unless otherwise indicated.

As used herein, "comprising" means that other steps and other ingredients which do not affect the end result can be added. This term encompasses the terms "consisting of" and "consisting essentially of".

All cited references are incorporated herein by reference in their entireties. Citation of any reference is not an admission regarding any determination as to its availability as prior art to the claimed invention.

The present invention meets the aforementioned needs in the art by providing a process which produces a detergent composition from liquid acid precursor of anionic surfactant and alkaline inorganic materials. The present invention also meets the aforementioned needs in the art by providing a process which produces a granular detergent composition for flexibility in the ultimate density of the final composition from agglomeration (e.g., non-tower) process. The process does not use the conventional spray drying towers currently which is limited in producing high surfactant loading compositions. In addition, the process is more amenable to environmental concerns in that it does not use spray drying towers which typically emit particulates and volatile organic compounds into the atmosphere.

As used herein, the term "agglomerates" refers to particles formed by agglomerating materials with binder such as surfactants and or inorganic solutions/organic solvents and polymer solutions. As used herein, the term "granulating" refers to fluidizing agglomerates thoroughly for producing free flowing, round shape granulated-agglomerates. As used herein, the term "mean residence time" refers to following definition: "mean residence time (hr)=mass (kg)/flow throughput (kg/hr)".

All viscosities described herein are measured at 30–70° C.

In accordance with one aspect of the invention, a non-tower process for preparing detergent agglomerates is provided. The process comprises the following steps: (i) fluidising powder materials in a high-speed mixer/granulator having both a stirring action and a cutting action, the powder materials comprising: particulate solid water-soluble alkaline inorganic material in an amount in excess of that required for neutralization, optionally in admixture with one or more other particulate solids, and recycled fines, the powder materials having a total surface area; (ii) adding the liquid detersive materials to the high-speed mixer/granulator, the liquid detersive materials comprising: a liquid acid precursor, optionally in admixture with one or more other liquid materials, whereby neutralization of the acid precursor by the water-soluble alkaline inorganic material occurs; and (iii) granulating the mixture in the high-speed mixer/granulator to form detergent particles, wherein the ratio of the total surface area of the powder materials to the amount of liquid detersive materials in step (ii) is from about 0.02 to about 140.

The present invention provides many benefits. Although not wanting to be limited by theory, it is believed that by controlling the ratio of the average surface area of the powder materials, which includes the recycled fines, to the amount of liquid detersive materials, the generation of fines can be controlled. In one typical process, fines are generated from a fluid bed cooler via a mixer, collected in a bin, and then fed back to the mixer. If more fines are generated than are fed back (or recycled back), this unbalance would cause the accumulation of fines in the bin and eventually shut down the system over time. It has been surprisingly found that by controlling the average surface area of powder materials and the amount of liquid detersive materials, a balance of the amount of generated fines with the amount of recycled fines can be made so that an over accumulation of generated fines do not shut down the detergent process.

In addition, there is provided a process for continuously producing a free-flowing detergent composition whose density can be adjusted for wide range of consumer needs, directly from starting detergent ingredients.

The present invention is directed to a process which produces free flowing, detergent agglomerates having wide range of density, e.g., from about 300 g/l to about 1000 g/l, especially for high dense detergent agglomerates e.g., from about 600 g/l to about 850 g/l.

Process

The powder materials are first fluidised in a high-speed mixer/granulator having both a stirring action and a cutting action. The powder material includes a particulate solid water-soluble alkaline inorganic material in an amount in excess of that required for neutralization. Optionally, other powder materials may be mixed with the alkaline inorganic material, such are recycled fines. Next, liquid detersive ingredients are added to the high-speed mixer/granulator, whereby a liquid acid precursor is added so that neutralization of the acid precursor by the water-soluble alkaline inorganic material occurs. Other liquid detersive ingredients, such as a neutralized anionic surfactant, e.g. coco fatty alcohol sulfate, a liquid chelant, and/or a nonionic surfactant, can optionally be added at this time. Liquid detersive ingredients may include paste forms. The mixture is subsequently granulated to form detergent particles, wherein the ratio of the total surface area of the powder materials to the liquid detersive materials is from about 0.02 to about 140. Preferably, the ratio is from about 0.03 to about 70; more preferably, the ratio is from about 0.04 to about 50.

In one typical example, the detergent particle is next agglomerated in a moderate speed granulator/densifier, with or without a separate powder stream, and then dried and/or cooled using for example, a fluid bed dryer/cooler, to form a particulate granular detergent composition.

Powder materials include particulate solid water-soluble alkaline inorganic materials. Such examples of inorganic materials include sodium carbonate, calcium carbonate, bicarbonates, and mixtures thereof: There should be a stoichiometric excess of particulate solid water-soluble alkaline inorganic over the liquid acid precursor.

Other powder materials include recycled fines, zeolite, phosphate, phosphonate, sulfate, silica, silicates, polymers including copolymers of maleic and acrylic acid, carboxymethyl cellulose, optical brighteners, ethylene diamine tetra acetic acid, and mixtures thereof. Other suitable ingredients, including additional surfactants, they may be handled as solids are described in detail below.

In addition to the salt of carbonate, the starting fine powder of the present process preferably selected from the group consisting of ground soda ash, powdered sodium tripolyphosphate (STPP), hydrated tripolyphosphate, ground sodium sulphates, aluminosilicates, crystalline layered silicates, nitrilotriacetates (NTA), phosphates, precipitated silicates, polymers, citrates, powdered surfactants (such as powdered alkane sulfonic acids) and internal recycle stream of powder occurring from the process of the present invention.

In the case of using hydrated STPP as the fine powder of the present invention, STPP which is hydrated to a level of not less than 50% is preferable.

The aluminosilicate ion exchange materials used herein as a detergent builder preferably have both a high calcium ion exchange capacity and a high exchange rate. Preferably, the aluminosilicate ion exchange material is in "sodium" form since the potassium and hydrogen forms of the instant aluminosilicate do not exhibit as high of an exchange rate and capacity as provided by the sodium form. Additionally, the aluminosilicate ion exchange material preferably is in over dried form so as to facilitate production of crisp detergent agglomerates as described herein. Preferably, the aluminosilicate ion exchange material has the formula $Na_z[(AlO_2)_z.(SiO_2)_y]xH_2O$ wherein z and y are integers of at least 6, the molar ratio of z to y is from about 1 to about 5 and x is from about 10 to about 264. More preferably, the aluminosilicate has the formula $Na_{12}[(AlO_2)_{12}.(SiO_2)_{12}]xH_2O$ wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

Liquid detersive materials include liquid materials which have a viscosity of from about 0 cps to about 5,000 cps, preferably from about 0 cps to about 3,000 cps and includes some paste forms. Examples of liquid acid precursors include anionic surfactant acids, amino polyphosphates, chelating agents, such as diethylene triamine penta acetic acid, and additional anionic surfactants (as neutralized salts), nonionic, cationic, ampholytic, zwitterionic surfactants, and mixtures thereof.

Useful anionic surfactant acids include organic sulphuric reaction products having in their molecular structure an alkyl group containing from about 9 to about 20 carbon atoms and a sulphonic acid. Examples of this group of synthetic surfactants are the alkyl benzene sulphonic acids in which the alkyl group contains from about 9 to about 15 carbon atoms in straight or branched chain configuration. Especially suitable anionic surfactant acids are linear alkyl benzene sulphonates in which the alkyl group contains from about 11 to about 13 carbon atoms. Other useful surfactant acids include alpha sulphonated fatty acid methyl esters, olefin sulphonates and beta alkyloxy alkanesulphonates. Mixture of the above may also be used.

A preferred liquid acid precursor is linear alkyl benzene sulphonic acid (HLAS). A preferred liquid material is coco fatty alcohol sulfate (CFAS). In one preferred composition, the ratio of CFAS:HLAS is from about 4:1 to about 8:1.

Other liquid detersive materials include amino polyphosphates, chelating agents, such as diethylene triamine penta acetic acid, and additional anionic surfactants (as neutralized salts), nonionic, cationic, ampholytic, and zwitterionic surfactants.

Other liquids may be sprayed into the high shear mixer including amino polyphosphates, diethylene triamine penta acetic acid and additional anionic surfactants (as neutralised salts), nonionic, cationic, ampholytic and zwitterionic surfactants.

Especially suitable amino polyphosphonates include diethylene triamine penta methylene phosphonic acid and ethylene diamine tetra methylene phosphonic acid.

Especially suitable additional anionic surfactants are water-soluble salts of the higher fatty acids. This includes water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil.

Other anionic surfactants herein are the sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Water-soluble nonionic surfactants are also useful as secondary surfactant in the compositions of the invention. A particularly preferred paste comprises a blend of nonionic and anionic surfactants having a ratio of from about 0.01:1 to about 1:1, more preferably about 0.05:1. Nonionics can be used up to an equal amount of the primary organic surfactant. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 4 to 25 moles of ethylene oxide per more of alcohol. Particularly preferred are the condensation products of alcohols having an alkyl group containing from about 9 to 15 carbon atoms with from about 4 to 25 moles of ethylene oxide per mole of alcohol; and condensation products of propylene glycol with ethylene oxide.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$, and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocalkyl trimethyl ammonium methosulfate.

Note that some of these components may be handled in solid form in which case they should be considered as part of the powder stream rather than liquid binders.

It is essential to the present invention that the ratio of the total surface area of the powder materials to the amount of liquid detersive materials is from about 0.02 to about 140. Preferably, the ratio is from about 0.03 to about 70; more preferably, the ratio is from about 0.04 to about 50. The ratio value of the total surface area of the powder materials is measured in $kg/m^2$ and is calculated as the average surface area of the powder materials:

$$\text{Total surface area of powder materials in m2/Kg} = \frac{\Sigma SA \text{ of each powder material rate}}{\text{Total powder material rate}}$$

Given the total surface area of powder materials as defined above, the ratio of the total surface area of the powder materials to the amount of liquid detersive materials is calculated as follows:

$$\text{Ratio in } m^2/\text{Kg-Kg} = \frac{\text{Total surface area of powder materials}}{\text{Total liquid (paste) detersive material loading}}$$

Typically, the total powder material rate used for industrial manufacturing scale ranges from about 500 to about 50,000 kg/hr. In addition, preferably, the liquid detersive material loading is from about 5 to about 50%, more preferably from about 10% to about 40%, and even more preferably from about 15% to about 25%.

If the liquid detersive material is a linear alkyl benzene sulphonic acid (HLAS), then the ratio of the total surface area of the powder materials to HLAS is from about 0.04 to about 50. If the liquid detersive material comprises a mixture of linear alkyl benzene sulphonic acid (HLAS) and coco fatty alcohol sulfate (CFAS), and if the ratio of CFAS:HLAS is from about 4:1 to about 8:1, then the ratio of the total surface area of the powder materials to the amount of liquid detersive materials is from about 0.04 to about 50.

The total surface area is calculated by any conventional method known in the art. One example is by Malvern, wherein the method applies the theory of laser-light-scattering by particles. Another example is BET, which is a method using a carrier gas, based on the Brunauer-Emmet-Teller (BET) theory.

To achieve the desired density, generally from about 300 g/l to about 1000 g/l, an agglomeration step is carried forth in a high speed mixer or a series of high speed mixers.

In the case of using single mixer, the examples of a high-speed mixer/granulator for the present invention can be any types of mixer known to those skilled in the art, as long as the mixer can maintain the following conditions. An example can be Lödige CB Mixers manufactured by the Lödige company (Germany), e.g. Lödige Recycler CB 60.

Generally speaking, the mean residence time of the starting detergent materials in the high speed mixer is preferably from about 2 to 45 seconds, more preferably-from about 2 to 20 seconds. The speed range of operation in the high speed mixer is preferably from 500 to 2000 rpm, more preferably from 650–850 rpm.

In the case of using a series of high speed mixers, the examples of a mixer for the present invention can be combinations of any types of mixer known to those skilled in the art, as long as one of the high speed mixer used for the present invention can maintain the conditions indicated above. An example can be a combination of one of Lödige CB Mixers manufactured by the Lödige company (Germany), and Flexomic Model manufactured by Schugi company (Netherlands); i.e., mixing starting detergent materials (which include an acid form of anionic surfactant, a first carbonate, and a second carbonate) are fed into a CB Mixer for agglomeration, subsequently, the resultant (agglomerate) from the CB Mixer is fed into a Flexomic Model for further agglomeration; or mixing starting detergent materials are fed into a Flexomic Model for agglomeration, subsequently, the resultant (agglomerate) from the Flexomic Model is fed into a CB Mixer for further agglomeration.

The agglomerates from process of the present invention can be subjected to further mixing process for further agglomeration of the product. This may be achieved by further mixing in a moderate speed mixer. An example of such moderate speed mixer can be Lödige KM Mixers manufactured by the Lödige company (Germany). Generally speaking, the mean residence time of the moderate speed mixer may be preferably from about 1 to 20 minutes, more preferably from about 10±5 min.

Adjunct Detergent Ingredients

The present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressors, antitarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Optional Process Steps

One optional step in the process is drying, if it is desired to reduce level of moisture in the agglomerates from the present process. This can be accomplished by a variety of apparatus, well known to these skilled in the art. Fluid bed apparatus is preferred, and will be referred to as the dryer in the discussion which follows.

In another optional step of the present process, the detergent agglomerates exiting the fluid bed dryer are further conditioned by additional cooling in cooling apparatus. The preferred apparatus for cooling is a fluid bed. Another optional process step involves adding a coating agent to improve flowability and/or minimize over-agglomeration of the detergent composition in one or more of the following locations of the instant process: (1) the coating agent can be added directly after the fluid bed cooler or dryer; (2) the coating agent may be added between the fluid bed dryer and the fluid bed cooler; and/or (3) the coating agent may be added between the fluid bed dryer and a mixer for agglomeration (i.e., the first mixer or the second mixer in the second step) which is commonly known to those skilled in the art. The coating agent is preferably selected from the group consisting of aluminosilicates, silicates, carbonates and mixtures thereof. The coating agent not only enhances the free flowability of the resulting detergent composition which is desirable by consumers in that it permits easy scooping for detergent during use, but also serves to control agglomeration by preventing or minimizing over-agglomeration. As those skilled in the art are well aware, over-agglomeration can lead to very undesirable flow properties and aesthetics of the final detergent product.

Optionally, the process can comprise the step of spraying an additional binder in a mixer(s) used for the present invention or fluid bed dryers and/or fluid bed coolers. A binder is added for purposes of enhancing agglomeration by providing a "binding" or "sticking" agent for the detergent components. The binder is preferably selected from the group consisting of water, anionic surfactants, nonionic surfactants, liquid silicates, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Other optional steps contemplated -by the present process include screening the oversized detergent agglomerates in a screening apparatus which can take a variety of forms including but not limited to conventional screens chosen for the desired particle size of the finished detergent product. Other optional steps include conditioning of the detergent agglomerates by subjecting the agglomerates to additional drying by way of apparatus discussed previously.

Another optional step of the instant process entails finishing the resulting detergent agglomerates by a variety of processes including spraying and/or admixing other conventional detergent ingredients. For example, the finishing step encompasses spraying perfumes, brighteners and enzymes onto the finished agglomerates to provide a more complete detergent composition. Such techniques and ingredients are well known in the art.

Another optional step in the process involves surfactant paste structuring process, e.g., hardening an aqueous anionic surfactant paste by incorporating a paste-hardening material by using an extruder, prior to the process of the present invention. The details of the surfactant paste structuring process are disclosed in the patent application Ser. No. PCT/US96/15960 (Procter & Gamble Co.), filed Oct. 4, 1996, now granted as U.S. Pat. No. 5,520,308.

The following examples further describe and demonstrate embodiments within the scope of the present invention. The examples are given solely for the purpose of illustration and are not to be construed as limitations of the present invention, as many variations thereof are possible without departing from the spirit and scope of the invention.

EXAMPLES

Example 1

The following is an example for obtaining agglomerates having high density (over 700 g/l), using a Lödige CB mixer (CB-30), followed by a Lödige KM mixer (KM-600), and lastly using Fluid Bed Apparatus for drying/cooling.

70 kg/hr of sodium aluminosilicate (mean particle size of 2.45 microns), 130 kg/hr of ground light sodium carbonate (mean particle size of 18.3 microns), 223 kg/hr of sodium tripolyphosphate (mean particle size of 22 microns), 130 kg/hr of sulfate (mean particle size of 165 microns), and 288 kg/hr recycled fines (mean particle size of 111 microns) are fluidised in a CB-30 mixer. The CB's rpm is preferably 900. The total surface area of all the powder materials is 1051 $m^2$/kg. 226 kg/hr of CFAS and 35 kg/hr of the acid form of alkyl benzene sulfonates (HLAS) are then added, whereby neutralization of the acid precursor by the water-soluble alkaline inorganic material occurs. The agglomerates from the CB-30 mixer are fed to the KM-600 mixer for further agglomeration, rounding and growing the size of the agglomerates. The KM's rpm is preferably 100. Choppers from the KM mixer can be used to reduce the amount of oversized agglomerates. The agglomerates from the KM mixer are fed to a fluid bed drying apparatus for drying and/or cooling. The resulting granules have a density of about 700 g/l. The total surface area of the powder materials to the amount of liquid detersive materials is about 4.0. The amount of generated fines is about 262 kg/hr.

Example 2

The following is an example for obtaining agglomerates having high density (over 500 g/l), using a Lödige CB mixer (CB-30), followed by a Lödige KM mixer (KM-600), and lastly using Fluid Bed Apparatus for drying/cooling.

500 kg/hr of sodium aluminosilicate (mean particle size of 2.45 microns), 2200 kg/hr of ground light sodium carbonate (mean particle size of 18.3 microns), 2600 kg/hr of sodium tripolyphosphate (mean particle size of 22 microns), 280 kg/hr of unground light sodium carbonate (mean particle size of 73 microns), and 2100 kg/hr recycled fines (mean particle size of 146 microns) are fluidised in a CB-30 mixer. The CB's rpm is preferably 750. The total surface area of all the powder materials is 1415 $m^2$/kg. 1525 kg/hr of the acid form of alkyl benzene sulfonates (HLAS) are then added, whereby neutralization of the acid precursor by the water-soluble alkaline inorganic material occurs. The agglomerates from the, CB-30 mixer are fed to the KM-600 mixer for further agglomeration, rounding and growing the size of the agglomerates. The KM's rpm is preferably 65. Choppers from the KM mixer can be used to reduce the amount of oversized agglomerates. The agglomerates from the KM mixer are fed to a fluid bed drying apparatus for drying and/or cooling. The resulting granules have a density of about 800–900 g/l. The total surface area of the powder materials to the amount of liquid detersive materials is about 0.93. The amount of generated fines is about 2100 kg/hr.

It is understood that the examples and embodiments described herein are for illustrative purposes only and that various modifications or changes in light thereof will be suggested to one skilled in the art without departing from its spirit and scope.

What is claimed is:

1. A non-tower process for preparing a granular detergent composition, the process comprising the following steps:

(i) fluidizing powder materials in a high-speed mixer/granulator having both a stirring action and a cutting action, the powder materials comprising: particulate solid water-soluble alkaline inorganic material selected from the group consisting of sodium carbonate, calcium carbonate, bicarbonates, zeolite, phosphates, sulfates and silicates in an amount in excess of that required for neutralization, optionally in admixture with one or more other particulate solids, and recycled fines, the powder materials having a total surface area;

(ii) adding liquid detersive materials to the high-speed mixer/granulator, the liquid detersive materials comprising: a liquid mixture of a linear alkyl benzene sulfonic acid (HLAS) and a coco fatty alcohol sulfate (CFAS), wherein the weight ratio of CFAS:HLAS is from about 4:1 to about 8:1, optionally in admixture with one or more other liquid materials, whereby neutralization of the HLAS by the water-soluble alkaline inorganic material occurs;

(iii) granulating the mixture in the high-speed mixer/granulator to form detergent particles, wherein the ratio of the total surface area of the powder materials to the amount of liquid detersive materials in step (ii) is from about 0.02 to about 140; and (iv) coating the detergent particles with a member selected from the group consisting of aluminosilicates, silicates, carbonates and mixtures thereof to enhance free flowability of the composition.

2. The process according to claim 1, further comprising the following steps:

(v) agglomerating the detergent particles in a moderate speed granulator/densifier, with or without a separate powder stream; and (vi) drying and/or cooling.

* * * * *